US006669130B2

(12) United States Patent
Rajala

(10) Patent No.: US 6,669,130 B2
(45) Date of Patent: Dec. 30, 2003

(54) FEEDING STRING

(75) Inventor: Gregory J. Rajala, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 98 days.

(21) Appl. No.: 10/055,573

(22) Filed: Oct. 26, 2001

(65) Prior Publication Data

US 2003/0080230 A1 May 1, 2003

(51) Int. Cl.[7] ..... B65H 51/20; B65H 59/20; B65H 20/00

(52) U.S. Cl. ..... 242/364.11; 242/419.4; 226/97.4

(58) Field of Search ..... 242/364.11, 364.4, 242/419.4, 365.7, 366.4, 366, 564.3; 226/97.4

(56) References Cited

U.S. PATENT DOCUMENTS

| | | | | | |
|---|---|---|---|---|---|
| 2,302,790 | A | * | 11/1942 | Modigliani | 28/283 |
| 2,350,182 | A | | 5/1944 | Neff | |
| 2,424,490 | A | * | 7/1947 | Henry | 242/366.4 |
| 2,678,173 | A | | 5/1954 | Phelps | |
| 2,771,180 | A | | 11/1956 | Barker | |
| 3,106,354 | A | * | 10/1963 | Kitselman | 242/364.11 |
| 3,747,863 | A | * | 7/1973 | Klementz et al. | 242/364.11 |
| 3,834,600 | A | | 9/1974 | Benchemoul | |
| 3,917,141 | A | | 11/1975 | Sartori | |
| 3,988,101 | A | | 10/1976 | Aspin | |
| 4,172,544 | A | * | 10/1979 | Pennings et al. | 226/97.4 |
| 4,678,132 | A | * | 7/1987 | Fowler et al. | 242/364.11 |
| 4,817,880 | A | * | 4/1989 | Lenk et al. | 242/366 |
| 4,890,800 | A | * | 1/1990 | Lenk et al. | 242/366 |
| 5,103,876 | A | | 4/1992 | Benz et al. | |
| 5,632,308 | A | * | 5/1997 | Bucher et al. | 139/28 |

FOREIGN PATENT DOCUMENTS

| | | | |
|---|---|---|---|
| GB | 2092188 | A * | 8/1982 |

* cited by examiner

*Primary Examiner*—Michael R. Mansen
(74) *Attorney, Agent, or Firm*—Senniger, Powers, Leavitt & Roedel

(57) ABSTRACT

Method of and apparatus for feeding string involving entraining the string around two godet rolls and driving one or both rolls in the direction for feeding the string forward. The string entrained around the rolls is tensioned by retarding the string upstream from the rolls with a gas flow and by accelerating the string downstream from the rolls with a gas flow.

32 Claims, 5 Drawing Sheets

FEEDING STRING

BACKGROUND OF THE INVENTION

This invention relates generally to feeding string, more particularly to a method of and apparatus for precision feeding of string forward to apparatus in which string is utilized.

The invention is especially concerned with feeding string forward from a supply to apparatus in which predetermined lengths of string are utilized, such as a high speed stringer for attaching string to items.

The term "string" as used herein encompasses what is ordinarily regarded as "string" as well as flexible string-like strands.

BRIEF SUMMARY OF THE INVENTION

In general, the method of the invention feeds string forward from a supply. The method comprises entraining the string coming from the supply around at least one feed roll, driving the roll in the direction for feeding the string forward, subjecting the string to a force in the reverse direction upstream from the roll, and subjecting the string to a forwarding force downstream from the roll. Apparatus of the invention generally involves a feed roll, a motor for driving the feed roll in the direction for feeding the string forward, a retarder for subjecting the string to force in the reverse direction upstream from the roll for retarding its forward feed, and an accelerator for subjecting the string to a forwarding force downstream from the roll for exerting a pull on the string to tension the portion of the string between the retarder and the accelerator.

Other features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figure 1:
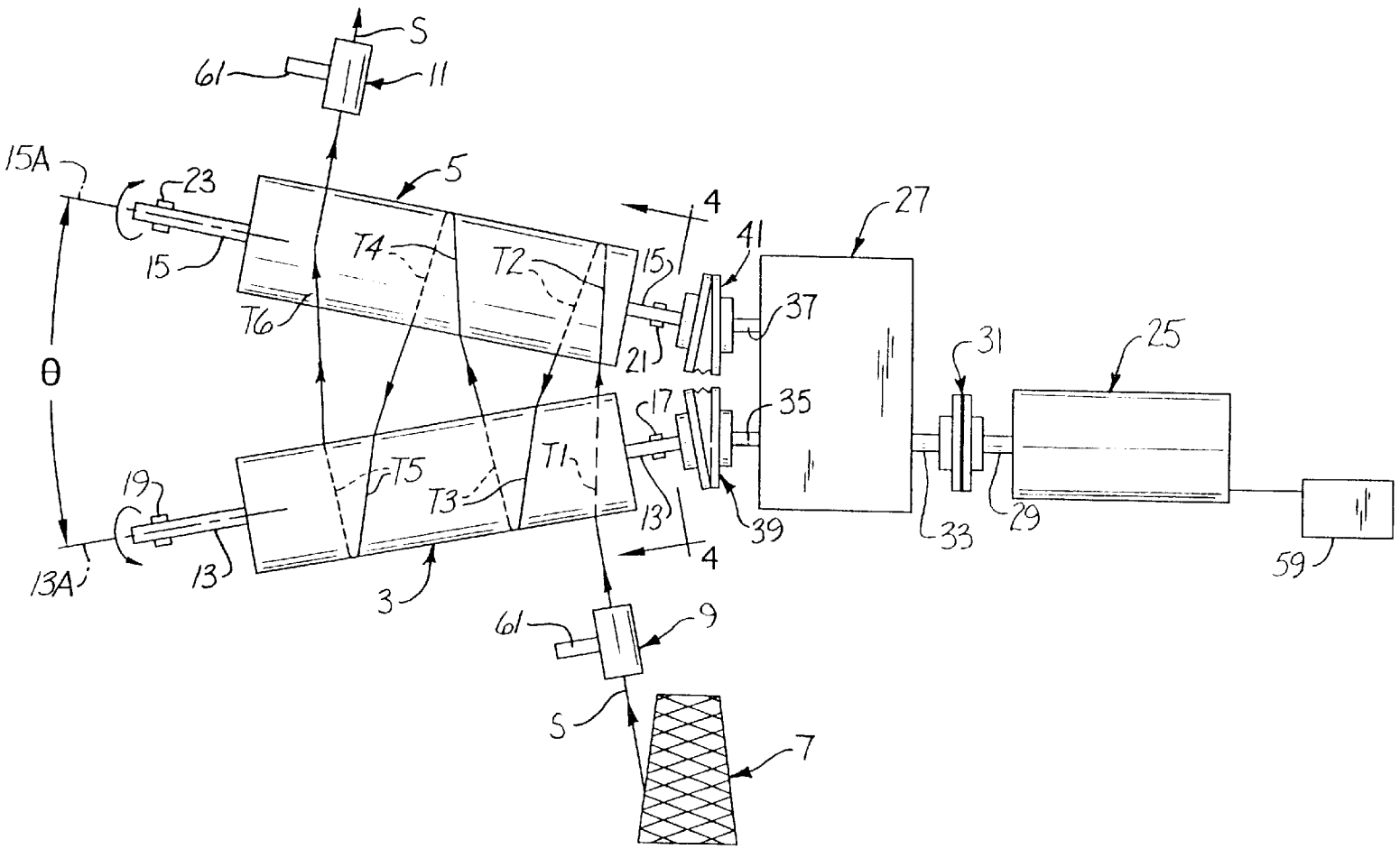
FIG. 1 is a semi-diagrammatic view of a first version of apparatus of this invention, said apparatus carrying out the generic method of the invention and a first species of the method.

Referring first to FIG. 1, an apparatus of this invention for carrying out the method of this invention, designated 1 in its entirety, is shown to comprise at least one feed roll and specifically two rolls 3 and 5 for feeding forward string S pulled from a supply 7. The supply 7 is shown as a cop of string, i.e., a wound supply on a conical bobbin. The string S coming from the supply (i.e., being unwound from the cop) is entrained around the rolls in a manner to be described, first around the first roll 3 and then around the second roll 5. Each roll is adapted to be positively driven in the direction for the forward feed of the string (as entrained around the rolls).

At 9 is generally indicated what may be broadly termed a retarder, operable as a drag brake or decelerator, for subjecting the string coming from the supply to force in a reverse direction with respect to the forward feed direction for retarding its forward feed. The retarder is interposed between the supply 7 and the first roll 3, i.e., upstream from the first roll. At 11 is generally indicated what may be broadly termed an accelerator for subjecting the string coming from the second roll 5 (i.e., downstream from the second roll) to a forwarding force. Being retarded (held back, in effect braked) upstream from the rolls and accelerated (pulled forward) downstream from the rolls, the reach of string entrained around the rolls is tensioned and travels around the rolls in good contact therewith.

Each of the rolls 3 and 5 is preferably a godet roll (i.e., a plastic-coated steel roll) of elongate cylindrical form. Roll 3 is on an axial shaft 13 and roll 5 is on an axial shaft 15. Shaft 13 is journalled in inboard and outboard bearings 17 and 19 and shaft 15 is journalled in inboard and outboard bearings 21 and 23. The axis 13A of roll 3 and the axis 15A of roll 5 (and hence the rolls) are oriented at an acute angle 2 to one another, divergent from the ends of the rolls at the inboard bearings 17, 21. Angle 2 may range from about two degrees to about thirty degrees, and in one embodiment angle 2 is about twelve degrees. The rolls are mounted in close proximity to one another.

Indicated at 25 in FIG. 1 is an electric motor, specifically a servomotor, for driving the rolls 3 and 5 via a gearbox 27 The output shaft 29 of the motor is coupled as indicated at 31 to the input shaft 33 of the gearbox. The latter is a reversing speed-reducing gearbox containing gearing for driving two output shafts 35 and 37 in opposite directions. The output shaft 35 of the gearbox is coupled as indicated at 39 to the roll shaft 13 and the output shaft 37 of the gearbox is coupled as indicated at 41 to the roll shaft 15.

Figure 2:
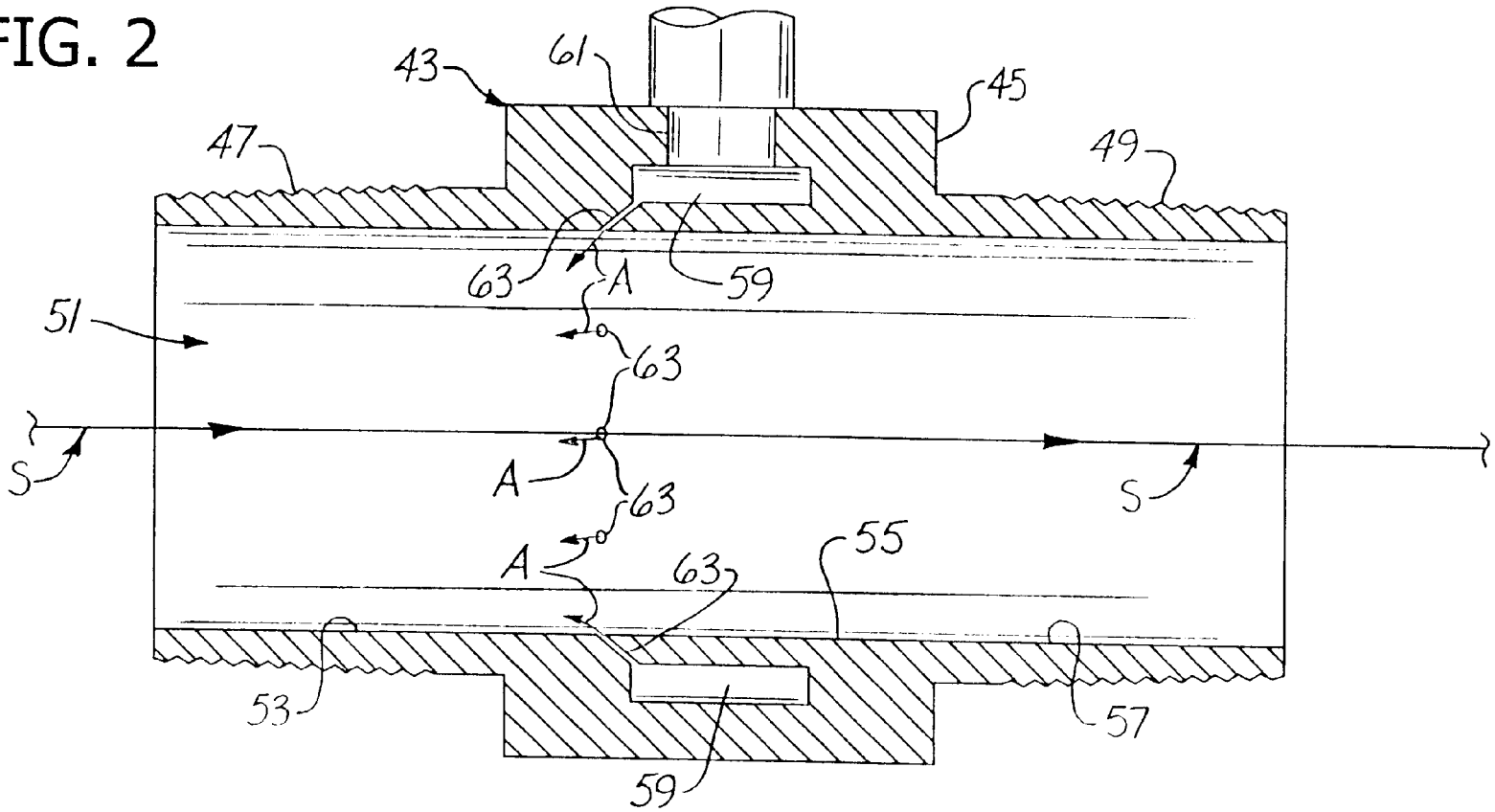
FIGS. 2 and 3 are enlarged longitudinal cross-sections of what are termed a "retarder" and an "accelerator" of the apparatus shown in FIG. 1.

The retarder 9 comprises an instrumentality which may be termed a venturi. The retarder 9 subjects the string to force in the reverse direction with respect to the forward feed of the string by gas flow, more particularly by a flow of air. The venturi which has been used is a commercially available item, in particular an EXAIR® unit sold by Exair Corporation of Cincinnati, Ohio. As shown in FIG. 2, this unit comprises a tubular body designated 43 in its entirety open at both ends having a central section 45 and end sections 47 and 49 (on opposite sides of the central section). Further, the unit has a passage 51 through the body 43 having an upstream section 53, an intermediate section 55 and a downstream section 57. The central section 45 of the body 43 has an annular plenum chamber 59. An air inlet 61 supplies air from a source under pressure (not shown) to the plenum chamber 59. Ports or nozzles 63 extend at an angle from the plenum chamber 59 to the central section 55 of the passage 51 for injecting air under pressure into section 55 in the direction of section 53 of the passage 51. Air blows out of the ports and through section 53 (note air direction arrows A in FIG. 2). String S, coming from the supply 7 (e.g., cop), travels through the passage 51 generally out of contact with the body 43 of the venturi 9, and is retarded in its travel by action of the air blowing on the string.

Figure 3:
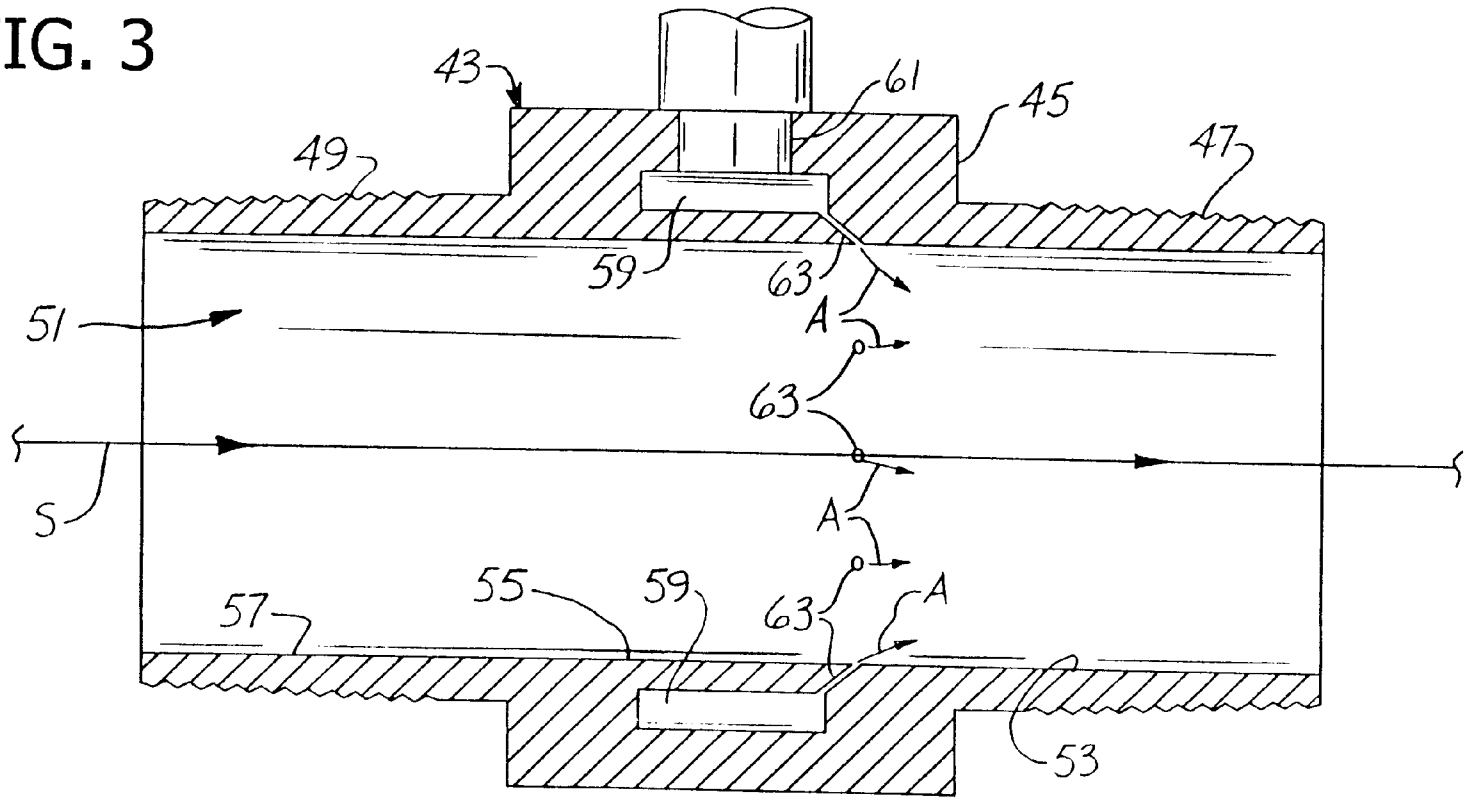

The accelerator 11 comprises a venturi similar to the retarder 9 but oppositely oriented as shown in FIG. 3 with from the retarder 9 as it appears in FIG. 2. String S, coming from the supply 7. travels first through section 53 then through sections 55 and 57 of the passage 51 of retarder 9, but string S, coming from the roll 5, travels first through section 57 then through sections 55 and 53 of the passage 51 of accelerator 11. String S traveling through the venturi 11 travels out of contact with the body 43 of venturi 11. Air blows out of the ports 63 of accelerator 11 and through section 53 of passage 51 of accelerator 11, thus subjecting the string to an accelerating force.

Figure 4:
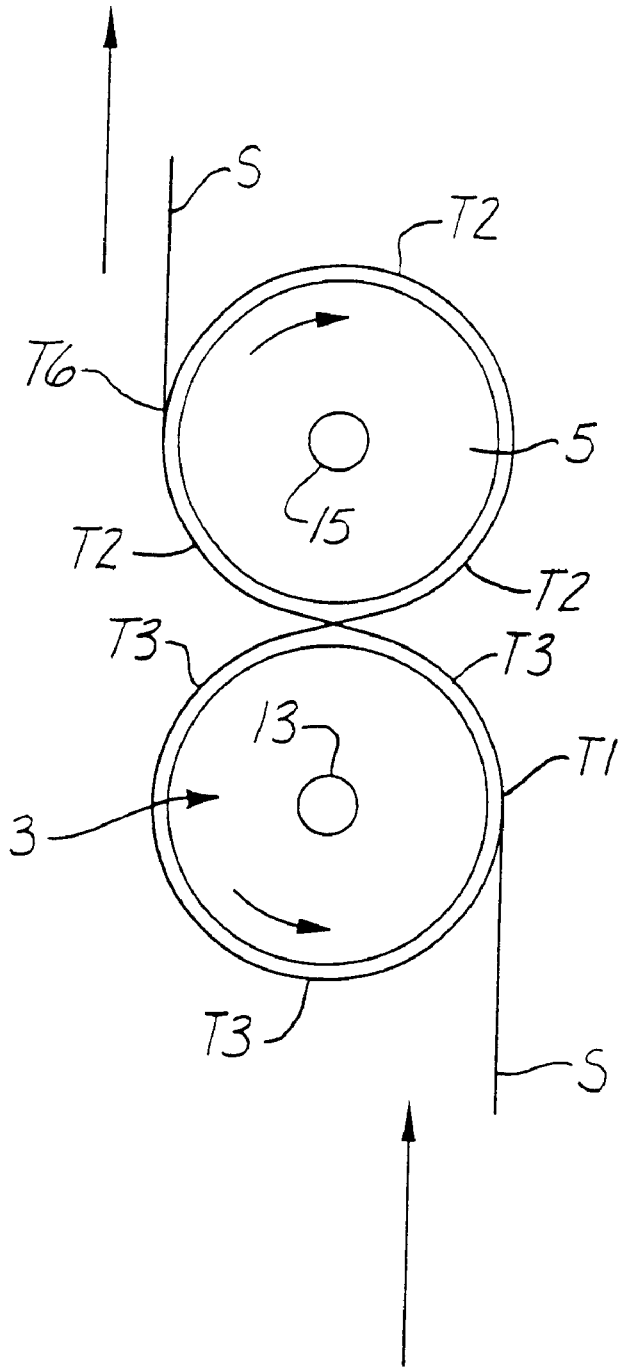
FIG. 4 is a cross-section generally on line 4—4 of FIG. 1 on a larger scale than FIG. 1.

The string S, coming from the supply 7 and threaded through the upstream venturi 9 is entrained around the first and second godet rolls 3 and 5 in a figure-8 path. As shown in FIG. 4, the entrainment involves the string first passing under and for about a one-quarter turn T1 around roll 3, then over and around roll 5 in almost a full turn T2, then back and over and around roll 3 in almost a full turn T3, then forward over and around roll 5 in almost a full turn T4, then back and over and around roll 3 in almost a full turn T5, and then forward and around roll 5 in about a one-quarter turn T6, then being threaded through the downstream accelerator 11. The turns are spaced axially on the rolls. As will be appreciated by those skilled in the art, the spacing between turns is dependent on the angle 2 between the axes 13A, 15A of the rolls 13, 15. The spacing increases with the angle 2.

During operation of the apparatus 1 of the present invention, predetermined lengths of string S are fed forward, issuing from the downstream accelerator 11 and fed to apparatus (not of this invention and not shown) in which the lengths of string are utilized. Rolls 3 and 5 are continuously driven by servomotor 25 via the gearbox 27 each in the direction for feeding the string forward in recurring cycles. During each cycle, the rolls 2 and 5 are first driven at a relatively low rate of speed (e.g., at a speed for feeding the string forward at 600–800 feet per minute), then sped up and driven at a higher rate of speed (e.g., at a speed for feeding the string forward at about 1200 feet per minute), then slowed down and driven at the aforementioned relatively low rate of speed. This slow-fast-slow cycle is obtained by controlling the servomotor 25 by a controller 59. The servomotor and controller which have been used are commercial item, in particular an ALLEN-BRADLEY® Model A320P-HKC22AA AC Servomotor and an ALLEN-BRADLEY® Model 1394 Servo Drive Control System, each of which are sold by Allen-Bradley Company Inc. of Milwaukee, Wis. The slow-fast-slow cycle typically involves operation at the slow speed for the first ¼ of the cycle, ramping up the speed to the high speed in the next ¼ of the cycle, running at the high speed for the third ¼ of the cycle, and slowing down to the low speed in the last ¼ of the cycle. The length of string fed forward on each cycle is determined by the number of revolutions of rolls 3 and 5 in the cycle, and the number of revolutions of the rolls during each cycle is a matter of the setting of the controller to operate the servomotor for the requisite number of revolutions of the rolls in each cycle interval. A typical setting where the rolls 3 and 5 are each four inch diameter rolls, making their circumference 12.57 inches (4B), is for rotation of the rolls roughly 1.23 revolutions in each cycle for feeding 15.5 inches of string on each cycle.

The retardation of the string by the upstream retarder 9 and the acceleration of the string by the downstream accelerator 11 subjects the string passing around the rolls 3 and 5 to tension which, though relatively low, is sufficient to maintain the string in relatively intimate frictional contact with the rolls, thus tending to insure accurate feeding of the string. This is achieved even when feeding the string at the non-constant rate as described above to feed apparatus utilizing the string at a non-constant rate. The angling and spacing of the rolls tends to prevent tangling of the turns on the surface of the rolls.

Figure 5:
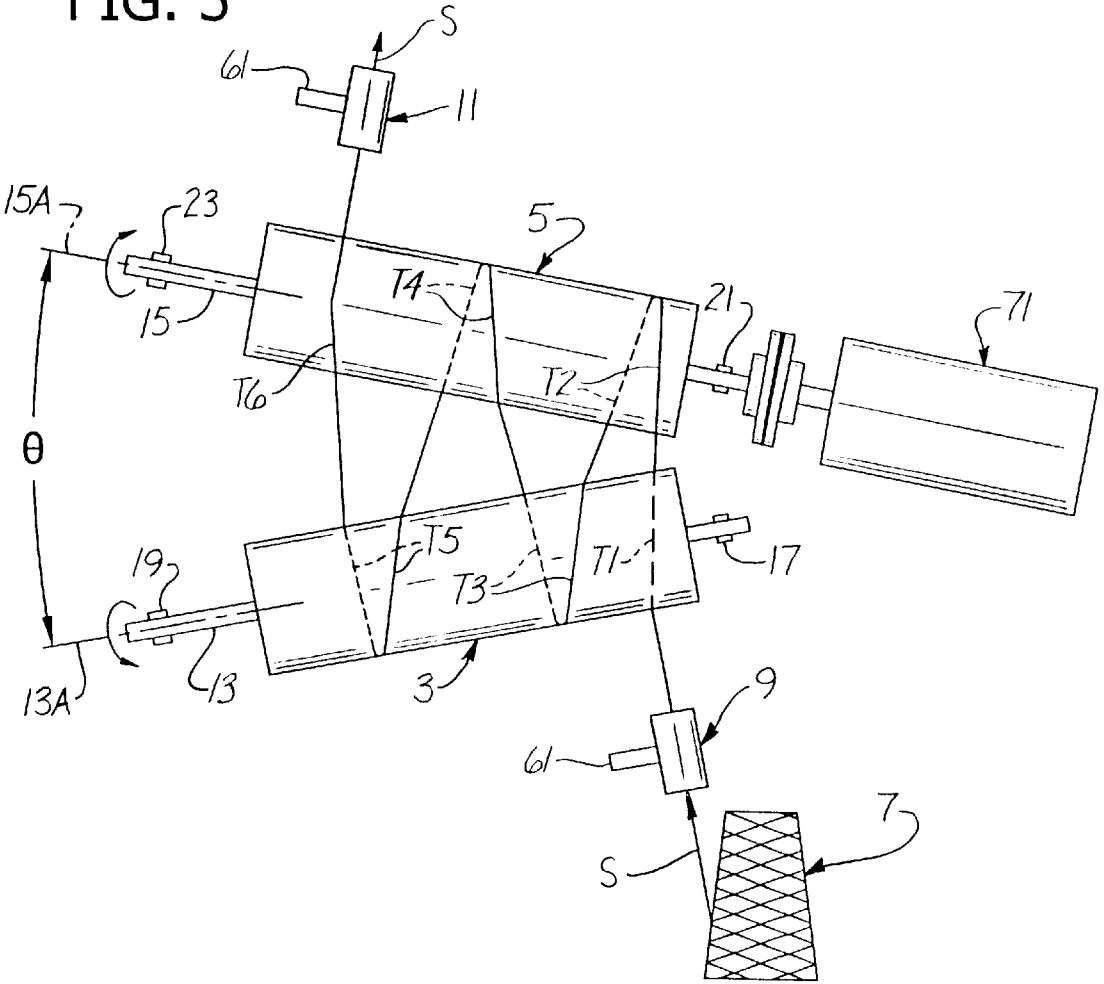
FIG. 5 is a semi-diagrammatic view of a second version of the apparatus, which also carries out the generic method and a second species of the method.

While the above-described method and apparatus continuously feed the string S forward in slow-fast-slow cycles (i.e., at a non-constant rate), the method and apparatus may be such as to feed the string forward continuously at a constant (invariant) rate. Such method and apparatus is illustrated in FIG. 5, being the same as illustrated in FIGS. 1–4 except that only the roll 5 is positively driven by an electric motor/speed reducer unit 71. Roll 3 idles under the torque imparted thereto by the string.

In view of the above, it will be seen that the several objects of the invention are achieved and other advantageous results attained.

As various changes could be made in the above constructions without departing from the scope of the invention, it is intended that all matter contained in the above description and shown in the accompanying drawings shall be interpreted as illustrative and not in a limiting sense.

When introducing elements of the present invention or the preferred embodiments thereof, the articles "a", "an", "the" and "said" are intended to mean that there are one or more of the elements. The terms "comprising", "including" and "having" are intended to be inclusive and mean that there may be additional elements other than the listed elements.

What is claimed is:

1. A method of feeding string forward from a supply, said method comprising:

entraining the string coming from the supply around at least one feed roll;

driving said roll in the direction for feeding the string forward;

subjecting the string to a force in the reverse direction upstream from said roll; and subjecting the string to a forwarding force downstream from said roll.

2. A method of claim 1 wherein the string is subjected to the force in the reverse direction by a gas flow.

3. A method of claim 1 wherein the string is subjected to the forwarding force by a gas flow.

4. A method of claim 1 wherein the string is subjected to each of said forces by gas flow.

5. A method of feeding string forward from a supply, said method comprising:

entraining the string coming from the supply around a first roll and then around a second roll;

positively driving at least one of the rolls in the direction for feeding the string forward;

subjecting the string to a force in the reverse direction upstream from the first roll; and subjecting the string to a forwarding force downstream from the second roll, the force in the reverse direction and the force in the forward direction being applied to increase the tension in the string entrained around the rolls.

6. A method of claim 5 wherein both rolls are driven in predetermined direction for feeding the string forward.

7. A method of claim 6 wherein the rolls are driven in opposite directions, the entrainment of the string around the rolls being such that each feeds the string forward.

8. A method of claim 7 wherein the string is entrained around the rolls in a figure-8 path.

9. A method of claim 5 wherein only the second roll is positively driven, the first idling under the torque imparted thereto by the string.

10. A method of claim 9 wherein the string is entrained around the rolls in a figure-8 path.

11. A method of claim 5 wherein the string is subjected to the force in the reverse direction by an upstream flow of gas.

12. A method of claim 5 wherein the string is subjected to the forwarded force by a downstream flow of gas.

13. A method of claim 5 wherein the string is subjected to the force in the reverse direction and to the forwarding force by upstream and downstream flows of air, respectively.

14. A method of feeding string forward from a supply, said method comprising:

entraining the string coming from the supply around a first godet roll and then around a second godet roll in a figure-8 path;

driving at least one of the rolls cyclically in the direction for feeding a length of string forward on each cycle;

blowing air in an upstream flow generally surrounding the string upstream from the first godet roll;

blowing air in a downstream flow generally surrounding the string downstream from the second godet roll;

the upstream and downstream flows of air subjecting the string to tension as it travels from the upstream flow around the rolls to the downstream flow.

15. A method of claim 14 wherein both the godet rolls are positively driven in cycles, being driven in opposite directions, the figure-8 path of the string being such that each feeds the string forward.

16. A method of claim 14 wherein only the second godet roll is positively driven in cycles, the first idling under the torque imparted thereto by the string.

17. Apparatus for feeding string forward from a supply, said apparatus comprising:

a feed roll;

a motor for driving the feed roll in the direction for feeding the string forward;

a retarder for subjecting the string to force in the reverse direction upstream from said roll for retarding its forward feed; and an accelerator for subjecting the string to a forwarding force downstream from said roll for exerting a pull on the string to tension the portion of the string between the retarder and the accelerator.

18. Apparatus as set forth in claim 17 wherein said retarder is a gas flow device.

19. Apparatus as set forth in claim 17 wherein said accelerator is a gas flow device.

20. Apparatus as set forth in claim 17 wherein both the retarder and accelerator are gas flow devices.

21. Apparatus for feeding string forward from a supply, said apparatus comprising:

first and second rolls for entrainment of the string coming from the supply there around, first around the first roll then around the second;

a motor for driving at least one of the rolls in the direction for feeding the string forward;

a retarder for subjecting the string to force in the reverse direction upstream from the first roll; and an accelerator for subjecting the string to a forwarding force downstream from the second roll.

22. Apparatus as set forth in claim 21 wherein the motor drives both rolls in the direction for feeding the string forward.

23. Apparatus as set forth in claim 22 wherein the motor drives a gearbox which drives the rolls in opposite directions.

24. Apparatus as set forth in claim 21 wherein the motor drives only one of the rolls and the other is an idler.

25. Apparatus as set forth in claim 21 wherein the retarder comprises a body having a passage for the string and an inlet for gas under pressure to flow through the passage in an upstream direction.

26. Apparatus as set forth in claim 21 wherein the accelerator comprises a body having a passage for the string and an inlet for gas under pressure to flow through the passage in a downstream direction.

27. Apparatus as set forth in claim 21 wherein the retarder comprises a body having a passage for the string and an inlet for gas under pressure to flow through the passage in an upstream direction and wherein the accelerator comprises a body having a passage for the string and an inlet for gas under pressure to flow through the passage in a downstream direction.

28. Apparatus for feeding string forward from a supply comprising first and second godet rolls for entrainment of the string coming from a supply first around the first roll and then around the second in a figure 8 path, a motor for driving at least one of the rolls in the direction for feeding the string forward, a retarder for subjecting the string to force in the reverse direction for retarding its forward feed, said retarder comprising a venturi having a passage for the string and an inlet for air under pressure to flow through the passage in an upstream direction, an accelerator for subjecting the string to a forwarding force downstream from the second roll for exerting a pull on the string to tension the portion of the string between the retarder and the accelerator, said accelerator comprising a venturi having a passage for the string and an inlet for air under pressure to flow through the latter passage in a downstream direction.

29. Apparatus as set forth in claim 28 wherein the motor is a servomotor, said apparatus having a gearbox driven by the servomotor and driving both rolls in opposite directions for feeding the string forward, said servomotor being under control to drive the rolls continuously in cycles each involving varying speed of the rolls for feeding predetermined lengths of string forward per cycle.

30. Apparatus as set forth in claim 29 wherein the servomotor is controlled to drive the rolls in cycles in each of which the rolls are first driven slow, then fast, then slow.

31. Apparatus as set forth in claim 28 wherein the motor drives only one roll and drives it at a constant rate, the other roll being an idler.

32. Apparatus as set forth in claim 28 wherein the rolls are at an acute angle to one another and in proximity to one another.

* * * * *

UNITED STATES PATENT AND TRADEMARK OFFICE

CERTIFICATE OF CORRECTION

PATENT NO. : 6,669,130 B2
DATED : December 30, 2003
INVENTOR(S) : Gregory J. Rajala It is certified that error appears in the above-identified patent and that said Letters Patent is hereby corrected as shown below:

Title page,
Item [56], Reference Cited, U.S. PATENT DOCUMENTS, Add:
-- U.S. Pat. No. 6,165,306, Gregory John Rajala, 12/26/00 --;

Column 3,
Line 27, "rolls 2 and 5" should read -- rolls 3 and 5 --.
Line 37, "A320P-HKC22AA" should read -- A320P-HK22AA --.

Signed and Sealed this

Twenty-fifth Day of May, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,669,130 B2
DATED : December 30, 2003
INVENTOR(S) : Gregory J. Rajala It is certified that error appears in the above-identified patent and that said Letters Patent is hereby corrected as shown below:

Title page,
Item [56], References Cited, U.S. PATENT DOCUMENTS, add:
-- 6,022,443, Gregory John Rajala, et al., issued 02/08/00 --.

Signed and Sealed this

Third Day of August, 2004

JON W. DUDAS
*Acting Director of the United States Patent and Trademark Office*